United States Patent [19]

Moll et al.

[11] Patent Number: 5,063,688

[45] Date of Patent: Nov. 12, 1991

[54] HAIR DRIER HOOD

[75] Inventors: Rainer Moll, Schwäbisch-Gmünd; Peter Kinast, Friolzheim; Hans Gessner, Kirchheim/Teck, all of Fed. Rep. of Germany

[73] Assignee: OLYMP Karl Herzog GmbH & Co., Stuttgart, Fed. Rep. of Germany

[21] Appl. No.: 446,617

[22] Filed: Dec. 6, 1989

[30] Foreign Application Priority Data

Dec. 6, 1988 [DE] Fed. Rep. of Germany ..... 8815146
Sep. 23, 1989 [DE] Fed. Rep. of Germany ..... 8911354

[51] Int. Cl.[5] ..... A45D 20/00
[52] U.S. Cl. ..... 34/97; 219/222
[58] Field of Search ..... 34/97, 99, 96; 219/222, 219/347

[56] References Cited

U.S. PATENT DOCUMENTS 4,914,273 4/1990 Matsui ..... 34/3

*Primary Examiner*—Henry A. Bennet
*Attorney, Agent, or Firm*—Toren, McGeady & Associates

[57] ABSTRACT

A hair drier hood is formed of an approximately sickle shaped laterally open cap (1) and a pair of arms (4, 5) located on the opposite sides of the cap. Each of said arm has a heating element (12), and a plurality of spaced apart heating elements (8) are located in the cap. A box shaped projection (2) is located at the end of the cap arranged to be located adjacent the neck of a person. A blower (13) is positioned in the projection (2) and arranged to direct air into the cap. In the cap (1) the heating elements (8) are separated from ducts (15, 16) by a reflector (10). The reflector (10) contain air outlet orifices (9) spaced apart along the cap. Air is directed through the ducts (15, 16) along the length of the cap (1) and passes through the air outlet orifices (9) and toward the head of the person using the drier.

12 Claims, 4 Drawing Sheets

HAIR DRIER HOOD

The invention relates to a hair drier hood comprising heating elements, particularly radiant infra-red heating elements, and a blower. The prior art appliances are, for the most part, of bell-shaped form and are found to be too hot due to the build-up of heat which accumulates. Furthermore, there is for the user a feeling of confinement caused by the fact that the head is substantially enclosed. In order to provide a basic improvement in this respect, and above all also to facilitate the work of the hairdresser, the invention provides for the use of a laterally open substantially sickle-shaped cap with heating elements, one arm fitted with heating elements extending on both sides substantially from one end and in the direction of the other end, while in the opposite direction there is a box-shaped member containing the blower. While the heat generated by the heating elements is above all assisted by the chemical processes, particularly in the case of permanent waving, the air generated by the blower can accelerate drying by extracting the moisture. By virtue of the lateral apertures, the confining feeling for the user can be overcome and, furthermore, the hairdresser has easy access to the head in order further to work on the hairstyle during the drying process.

Preferably, the cap extends still somewhat downwardly from the point of attachment so that there is complete access to the neck hairs. In order to be able more satisfactorily to adapt the hood to the shape of the head, the arms are expediently articulatingly mounted on the cap or on the point of attachment and are bent slightly outwardly. By reason of the pivotability of the arms, it is furthermore ensured that the hairdresser can continue to work even during the drying process and can pivot the arms away if he wishes to work on those parts of the hairstyle which are covered by them. For the most even possible distribution of the air into the space defined by the cap and the arms, it is according to a further feature of the invention, provided for the blower to be at the point of attachment connected to longitudinally extending air ducts in the cap and/or in the arms which comprise correspondingly orientated air-outlet orifices. In this case, the air outlet orifices are preferably shaped like nozzles and are, in particular, obliquely disposed so that the stream of air does not strike the head at a right-angle but as far as possible tangentially.

It is expedient if the ducts are covered by duct covers with air outlet orifices which are constructed as reflectors, the heating elements which are protected by grids being disposed in front of these latter. Here again it is ideal to avoid a direct irradiation as far as possible so that partial masking of the heating elements is ensured. In order to enhance the process of drying by the air and in order to allow no unpleasant feel of coldness to occur, the air is guided by the blower to the air ducts through one or a plurality of auxiliary heating elements.

A particularly favorable construction is achieved if the cap is of U-shaped cross-section and if this arrangement comprises two parallel air passages. These extend preferably and substantially over the width of the cap and are disposed above each other. The separating wall between the passages ends substantially at the lower third of the cap. The air stream from the passage immediately adjacent the air outlet apertures extends via the auxiliary heating elements. The other passage, on the other hand, expediently conveys air which has not been heated, since the reflectors are above all heated by the heating elements at the apex of the cap and they also heat up the air which passes over them. If it is desired also to preheat this air, then there would be a very uneven distribution of heat over the entire area of the cap. On the other hand, the heated air from the duct disposed at the air outlet orifices is already blown out in the lower part of the cap, in other words at a point which has only negligible heating of the reflectors disposed at that point.

To secure the arms in the cap or in the point of attachment, it is possible there to use balls which are connected to the arms and which have in particular apertures for connection between blower and air ducts. Instead of the balls, it is also possible to use, connected to the arms, sleeves which are rotationally and longitudinally displaceably mounted in hollow cylinder which are disposed with the cap. The rotational and longitudinal displaceability of the sleeves is thereby limited by abutments and there is provision for one or more catch positions. A particularly simple construction of the hood is achieved if the cap with its projections is divided into two approximately at the height of the point at which the arms are articulatingly connected to it, and if in each case half shells or in one part hollow cylinders are provided which have balls or sleeves connected to the arms for mounting purposes.

By way of heaters for drying the hair, mostly electrical heating elements are used which take the form of infra-red radiating elements. It is expedient for the wire filaments disposed on the radiant heaters to be closely wound on the outside and to be more openly wound on the inside. The heat generated by the radiant heaters is namely mostly concentrated in the middle of the cap cross-section so that it is logical that this area should be less heated by the radiant elements and to generate more heat in the outer areas. A particularly simple method of fixing the infra-red radiant heating elements is possible by resiliently mounting contact pins in the sides of the cap, which can at the same time serve to supply current.

For controlling the blower and the heating elements, a control device, particularly a pivotable control device, is preferably disposed on the box-like projection. In addition, it is expedient to provide at the free end of the cap a pivotable control device, particularly for special functions.

The drying hood according to the invention can dry both without an air supply and also with any desired preselectable quantity of air. This provides for ready adaptability of the drying conditions to the most widely diverse types of hair and hairstyle.

In order to prevent a build-up of heat under the hair drying hood and excessive heating of the skin on the wearer's neck, a further feature of the invention proposes that an air duct with air outlet orifices should extend in the hood, an auxiliary heating unit being disposed between the blower and the air duct, the latter having in the direction of flow and upstream of the auxiliary heating element an outlet orifice which is connected to outlet orifices which point into the interior and which are disposed substantially at the bottom end of the hood. The air generated by the blower and passed to a certain extent through the air duct to the user's hair can then, by the extraction of moisture, accelerate the drying of the hair, so reducing the period of time which the user has to spend under the drier. By reason of the outlet orifice in the air duct, part of the air generated by the blower is directed at the neck area of the user. Therefore, not only is the heating of this area during the drying process eliminated, but the user enjoys a feeling of general cooling by virtue of this additional air flow.

There is preferably over the outlet orifice a separable occluding means, so that the flow of air directed at the neck area can be allowed through only if required. In order also to be able to regulate the strength of the air flow, a further development of the invention provides for the occluding means to be connected to a device for regulating the free passage through the outlet orifice. A further development of the invention resides in that a secondary air duct is constructed between the outlet orifice of the air duct and the outlet orifices of the hood. This provides a simple connection between the outlet orifice and the outlet orifices, since instead of individual air ducts, there is one common secondary air duct which is connected to all the outlet orifices. Since the outlet orifices are so disposed that the whole of the user's neck can be cooled, the secondary air duct preferably extends over the width of the hood. In order to generate a directed flow of air for cooling purposes, it is particularly favorable for at least one of the outlet orifices to comprise an air guide which extends obliquely downwardly to the inner wall of the hood. Preferably, the air guide is constructed as a gap, the depth of which is about three times its width, the gap extending at an angle of about 30° to the inner wall. A further development of the invention resides in that there is in the secondary air duct a secondary air heating arrangement. For users with long neck hair, the stream of air which is directed at the neck area can also be used for drying the neck hair when this secondary air heating arrangement is switched on. In order to be able individually to adjust the drying process, the secondary air heater is connected to a temperature regulating device.

An alternative embodiment of the invention provides that, in the cases of a hair drier hood with heating elements, particularly infra-red heating elements and a blower and with an operating device having indicating elements for blower, heating elements, etc., the operating device should comprise an indicating panel which is hinged to fold over the indicating elements and which, when it rests on the, actuates a switch to switch-over the indicating elements. Various drying can be selected by means of the operating device, the indicating elements indicating the particular status of operation at any give time. By virtue of the indicating panel, further operating conditions or drying can be displayed, the switch-over being carried out easily. It has been found to be particularly suitable for the switch to consist of a magnet which is connected to the hinged indicating panel, particularly to the spindle about which it rotates, and a Hall contact which is disposed on the operating device.

In the case of prior art hair drying hoods, the temperature of the heating elements is controlled by means of temperature sensors which are mostly rigidly clamped into the hair. A preferred embodiment of the invention envisages providing a temperature sensor, particularly a heat-responsive element, to be pivotally mounted on the hood and to project into the interior thereof and to be connected with a device for controlling the heat of the heating elements. In the case of a temperature sensor according to the aforesaid feature, the work of attachment is unnecessary since the temperature sensor according to the invention is automatically applied against the user's hair and matches any variation in the position of the head. Simpler control of the temperature in any attitude of the user's head is thus possible. Expediently, the temperature sensor is fixed to the cross rail of a U-shaped support, one end of each of the two arms of the support being pivotally mounted on the hood. A further advantageous development is achieved by providing a device for measuring the angle between the hood and the support and which is connected to the heat control device for the heating elements. Since the angle is in a direct relationship to the attitude of the user's head, it is possible with this measuring device to control the heat controlling device, individually in any head position.

By way of example, embodiments of the invention are shown in the accompanying drawings, in which.

Figure 1:
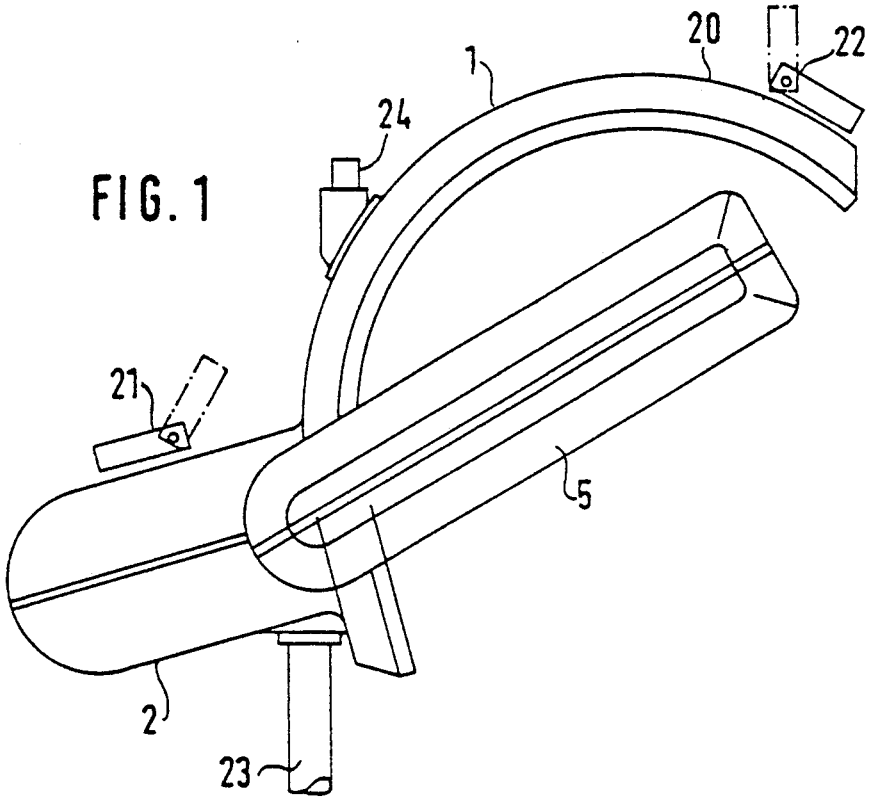
FIG. 1 is a side view of a drier hood with the stand broker away.
Figure 2:
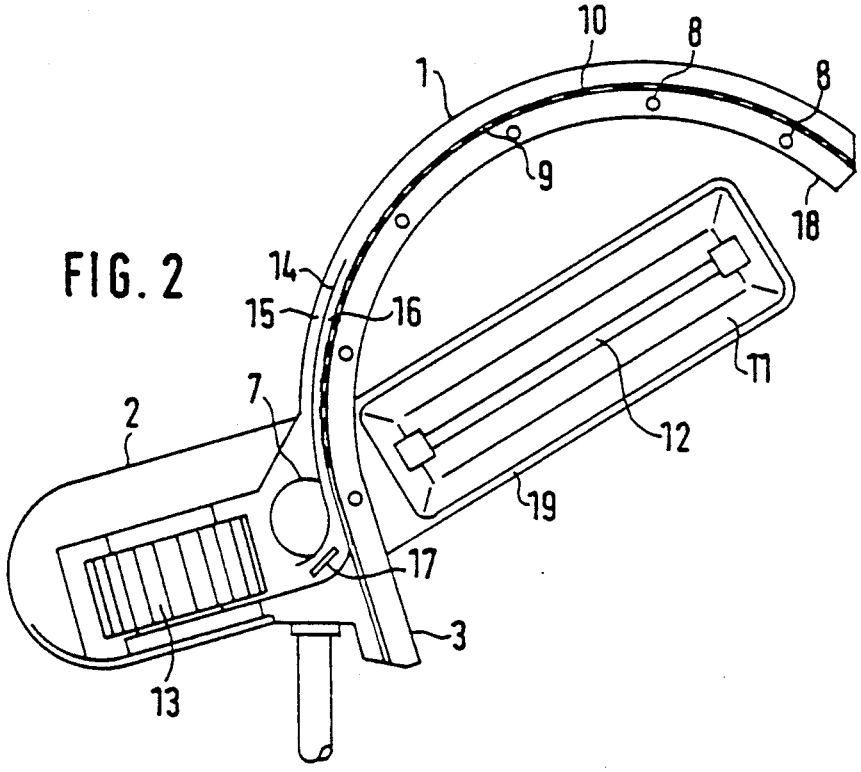
FIG. 2 is a sectional view of FIG. 1.
Figure 3:
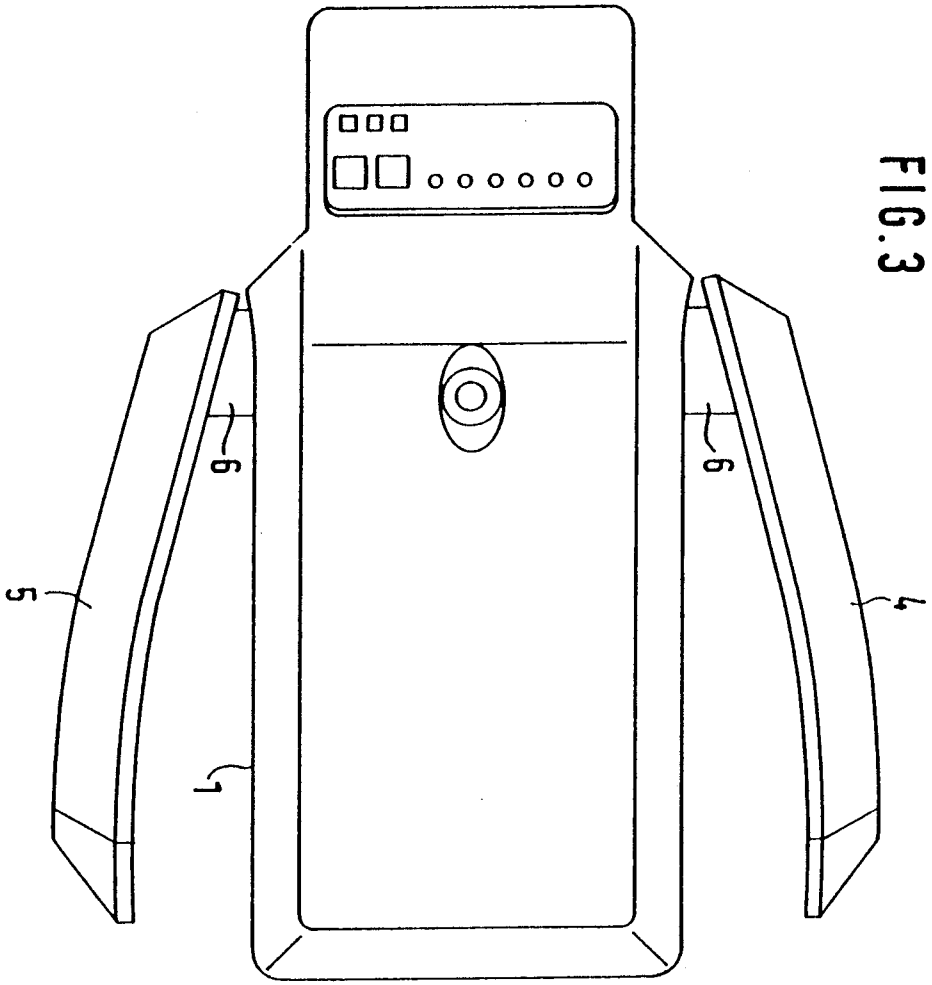
FIG. 3 is a plan view of FIG. 1.
Figure 4:
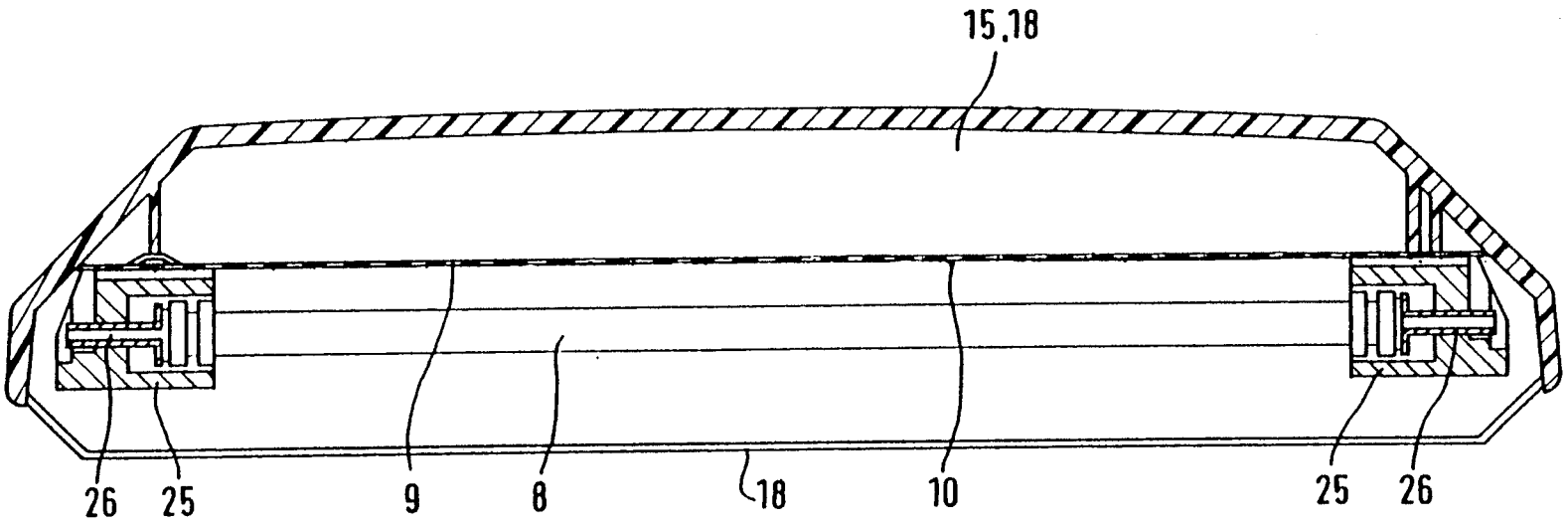
FIG. 4 is a cross-section through the cap on an enlarged scale and substantially at the apex of the cap.

The drying hood consists of a sickle-shaped curved cap 1 and, disposed substantially at its bottom end, a box-like projection 2, the cap 1 extending downwardly from the projection 2 by a portion 3. At the junction of the cap 1 and the projection 2 there are two pivotally mounted arms 4 and 5. Sleeves 6 are connected to the arms 4 and 5 and in the cap 1 or the projection 2 there are hollow cylinders 7. in which these sleeves are mounted for rotation and longitudinal displacement. The cap 1 has a U-shaped cross-section and carries transversely to its longitudinal direction regularly distributed electrically operated infra-red radiant heats 8 behind which there is a reflector 10 provided with air outlet orifices 9. The arms 4 and 5 each comprise an infra-red radiant heater 12 in a reflector housing 11.

Disposed in the box-like projection 2 is a tangential blower 13, the air flow from the which extends lengthwise in the U-shaped cross-section of the cap 1, emerging through the air outlet orifices 9 into the space between the cap 1 and the arms 4, 5. A partition 14 forms thereby two ducts 15 and 16. To heat the air, there is in the duct 16 adjacent the air outlet orifices 9 an auxiliary heating element 17. The air which is heated by this then emerges largely into the bottom part of the cap. In the duct 15 which is behind it, on the other hand, air delivered directly by the blower 13 and without being preheated passes into the upper and forward parts of the cap 1 where it can emerge through the air outlet orifices 9. Here, in fact, the reflector 10 is so intensely heated by the infra-red radiant heaters that the air is already heated. In this way, there is a substantially more even distribution of heat over the entire cap area. In order to prevent injuries due to unintentional touching of the infra-red radiant heaters 8 and 12, grids 18 and 19 are disposed in front of them.

The infra-red radiant heaters 8 and 12 are held in mountings 25. For this purpose, there are disposed inside the mountings longitudinally displaceably mounted contact pins 26 biassed against springs which serve both to fix the infra-red radiant heaters 8, 12 and also to supply current. Both on the projection 2 and also on the front end 20 of the cap 1 thee are devices 21 and 22 for controlling the heating and the blower and these are pivotally disposed, both being capable of assuming the positions shown in the drawing. Furthermore, the hood has a stand mounting 23. Instead of this, a wall mounting 24 can be used.

Figure 5:
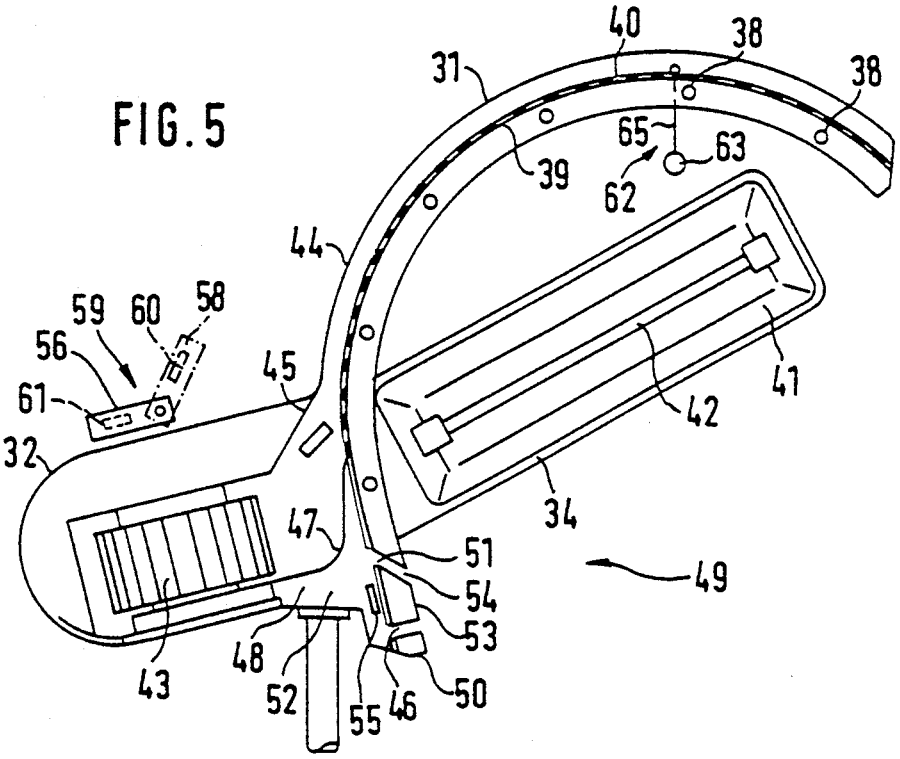
FIG. 5 is a view according to FIG. 2 but of a different embodiment.
Figure 6:
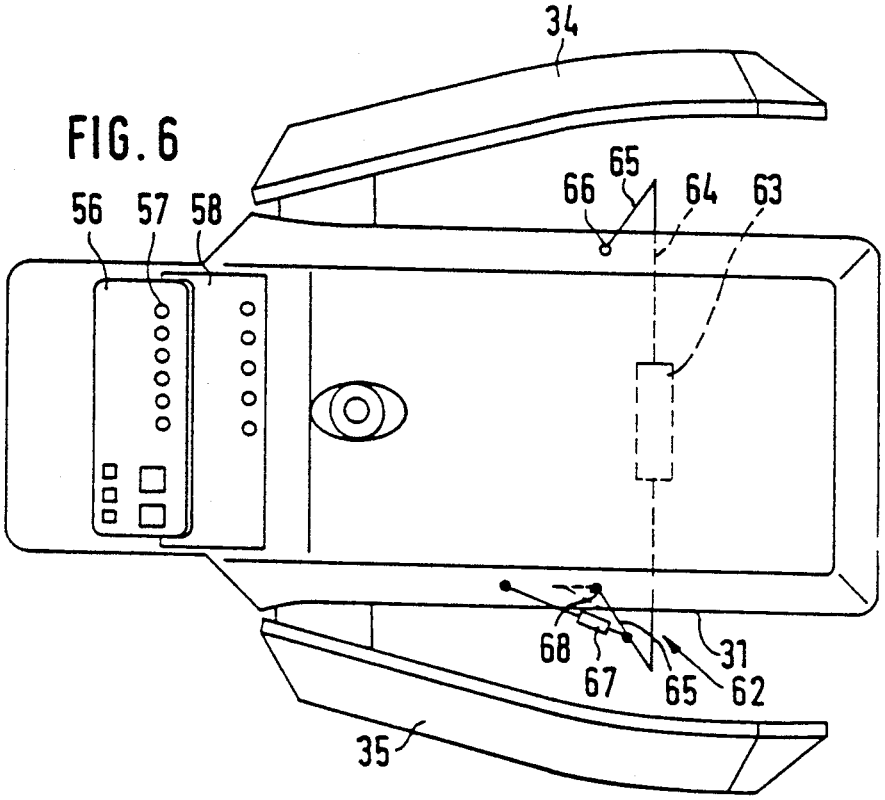
FIG. 6 is a plan view of FIG. 5

The drier hood shown in FIGS. 5 and 6 consists of a cap 31 which is curved to a sickle shape and a box-like projection 32 disposed substantially at its bottom end, the cap 31 also comprising a portion 33 which extends downwardly from the projection 32. Pivotally mounted at the junction between the cap 31 and the projection 32 are two arms 34 and 35. The cap 31 is of U-shaped cross-section and carriers, transversely to its longitudinal direction, evenly distributed electrically operated infra-red radiant heaters 38, behind which there is a reflector 40 provided with air outlet orifices 39. The arms 34 and 35 each comprise an infra-red radiant heater 42 in a reflector housing 41.

Disposed in the box-like projection 32 is a blower 43, the stream of air from which extends longitudinally in an air duct 44 in the U-shaped cross-section of the cap 31 emerging through the air outlet orifices 39 into the space between the cap 31 and the arms 34, 35. For heating the air, an auxiliary heating element 45 is disposed in the air duct 44. In the direction of flow, upstream of the auxiliary heating element 45, the air duct 44 comprises an outlet orifice 47 which is constructed a san aperture through a baffle 48. The baffle 48 extends from the blower 43 to the cap 31 where it is bent over at a right-angle and passed to the auxiliary heating element 45. Provided at the outlet orifice 47 is a separable occluding means which can be controlled by a regulating device not shown in the drawings. The free passage through the outlet orifice 47 can be varied by means of this control device. Furthermore, the outlet orifice 47 is connected for flow, via a secondary air duct 52, to outlet orifices 46, 51 disposed above a bottom end 50 of the drier hood and directed into the interior 49 of the cap 31. The secondary air duct 52 extends over the width of the hood. Those outlet orifices 51 which are disposed close to the outlet orifice 47 comprise an air guide 54 which extends obliquely downwardly towards the inner wall 53 of the hood. The depth of the air guide is about three times greater than its width and it extends at an angle of about 30° to the inside wall 53. A further outlet orifice 46 is disposed close to the bottom end 50 of the hood and is constructed as a horizontal slit. Inside the secondary air duct 52, between the bottom outlet orifice 46 and the upper outlet orifices 51, there is a secondary air heater 55 which is connected to a temperature regulating device which is not shown in the drawings.

On the extension or projection 32 is an operating device 56 comprising indicating elements 57 to show the working status of blower, heating elements and secondary air heater. Pivotally mounted on the operating device 56 is an indicating panel 58 hinged to fold onto the display elements 57. When the indicating panel 58 is resting on the elements 57, it operates a switch 59 to switch over the indicating elements 57. The switch 59 consists of a magnet 60 connected to the indicating panel 58 and a Hall contact 61 disposed on the operating device 56.

On the upper part of the cap 31 is a U-shaped support 62 for a temperature sensor 63 which consists of a cross rail 64 and the two support arms 65. In each case one and 66 of the two support arms 65 is pivotally mounted on the cap 31. The temperature sensor 63 is fixed on the cross rail 64 and connected to a device (not shown in the drawings) for controlling the heating elements. Also disposed on the cap 31 is a measuring device 67 which measures the angle 68 between the cap 31 and the support 62. It is connected to the heating control of the heating elements and, according to the size of the angle 68, it controls the heating output from the heating elements.

When the drier hood is in use, the air generated on the one hand by the blower 43 and heated by the auxiliary heating element 45 is passed through the air duct 44 and the air outlet orifices 39 into the interior 49 of the hood and so is directed onto the hair of the user. On the other hand, a part of the cool air generated by the blower is drawn through an outlet orifice 47 from the air duct 44 upstream of the auxiliary heating element and is passed through the secondary air duct 52 and the outlet orifices 51 with the air guide 54 and into the interior 49 of the hood and is thus directed at the neck area of the user who experiences the cooling effect of this air flow. By reason of the occluding member and the control device, the air flow can be switch both on and off and its strength can also be regulated. The air flow can furthermore be directed through the bottom outlet orifice 46 onto the neck area, the secondary air heater 55 disposed in the secondary air duct 52 making it possible to heat this flow of air so that if the user has long hair the drying process in the neck area can be accelerated.

Various drying programs can be selected via the operating device 56 with display elements 57 to show the working status of blower, heating elements, etc. To indicate further working conditions and drying programs, the indicating panel 58 can be folded over onto the indicating elements 57 and when the indicating panel 58 is resting on them, a switch 59 is actuated which switches over the indicating elements 57.

The heating control of the heating elements, required for different drying programs is achieved via the temperature sensor 63. By reason of its pivotable suspension on the cap 31 via the support 62, the temperature sensor 63 can be applied to the hair without problem even when the head is in different positions. The variation in heat output from the heating elements which is required for different attitudes of the head is controlled by a measuring device 67. The measuring device 67 can, for example, be constructed as a sliding resistor, the resistance of which alters if there is a variation in the position of the user, the variation following the variation in the angle between the support 62 and the cap 31.

We claim:

1. A hair drier hood comprising a laterally open cap (1) having a first end arranged to be located approximately adjacent the neck of a person and a second end arranged to be located over the forward portion of the person's head and said cap curving approximately in a sickle shaped upwardly from the first end to the second end, heating elements (8) located with said cap (1) extending transversely of the first end - second end direction and disposed in spaced relation, a pair of arms (4, 5) extending from said first end and each located laterally outwardly from an opposite side of and below said cap generally alongside the head of the person, at least one heating element (12) in each said arm (4, 5), a box shaped projection (2) extending outwardly from the first end of said cap in the direction away from the second end, a blower (13) located within said projection (2) and arranged to direct air into said cap (1), means (10) in said cap for forming air outlet orifices (9) spaced apart between said first and second ends for directing air over said heating elements (8) into a space bounded by said cap (1) and arms (4, 5), said cap having at least one air duct (15, 16, 44) on an opposite side of said air inlet orifices (9) from said heating elements (8) and extending in the direction from the first end toward the second end and communicating between said blower (13) and said air outlet orifices (9).

2. A hair drier hood, as set forth in claim 1, wherein said means (10) for directing air comprises a reflector (10) between said ducts and said heating elements (8), said reflector arranged to direct heat from said heating elements into the space inwardly of said cap and arms, and said air outlet orifices (9) are nozzle shaped and obliquely oriented relative to said reflector (10).

3. A hair drier hood, as set forth in claim 2, wherein within said projection (2) and located between said blower (13) and said air ducts (16) is at least one auxiliary heating element (17) said cap (1) is U-shaped transverse to the direction between the first and second ends and comprises two parallel said air ducts (15, 16) one closer to said reflector than the other with said air ducts extending substantially over the width of said cap (1) externding transversely of the direction between said first and second ends, a partition (14) separating said air ducts (15, 16) with said partition extending from said first end toward said second end for approximately one-third of the dimension between the first and second ends, said auxiliary heating element (17) is located in the path of one of said ducts disposed closer to said reflector (10).

4. A hair drier hood, as set forth in claim 1, wherein means are located in the region of the first end of said cap for pivotally securing said arms relative to said cap and said means afford a number of catch-defined positions for said arms.

5. A hair drier hood, as set forth in claim 4, wherein said arms are pivotally mounted on said projection on an axis extending transversely of the direction between the first and second ends of said cap, said projection being divided in two along a plane containing the pivot axis of said arms, and said means for connecting said arms comprising a sleeve (6) connected to each of said arms and hollow cylinders (7) mounted in said projection and extending into said sleeve for the rotation of said arms.

6. A hair drier hood, as set forth in claim 1, wherein said heating elements are radiant infra-red heating elements including wire filaments closely wound at the outside of said heating elements and loosely wound on the inside thereof, and resiliently mounted contact pins (26) located in said cap (1) to fix and supply current to said heating elements (8, 12).

7. A hair drier hood, as set forth in claim 1, wherein said means for forming at least one air duct comprises one said air duct (44), an auxiliary heating element (45) located between said blower (43) and said air duct (44), an auxiliary outlet orifice (47) located between said blower in said projection and the first end of said cap, and second air outlet orifices (46) located in said cap at the first end thereof for directing air into the space defined by said cap and said arms.

8. A hair drier hood, as set forth in claim 7, wherein occluding means positioned at said auxiliary outlet orifice (47) for controlling the passage of air through said auxiliary outlet orifice.

9. A hair drier hood, as set forth in claim 7, wherein a secondary air duct (52) extends across the width of said cap transversely of the direction between the first and second ends thereof and extends between said auxiliary outlet orifice (47) and said second air outlet orifices (46).

10. A hair drier hood, as set forth in claim 9, wherein at least one-third air outlet orifice (51) is located adjacent said second air outlet orifice (46) and more remote from the first end of said cap than said second air outlet orifice, said third air outlet orifice extending obliquely downwardly toward the first end of said cap, said third air outlet orifice comprises an air guide (54) having a depth substantially three times the width thereof and extending at an angle of approximately 30 degrees to walls (53) of said cap facing into the space within said cap and arms, and a secondary air heater (55) located within said secondary air duct (52).

11. A hair drier hood, as set forth in claim 1, including an operating device with indicating elements operatively connected to said blower and heating elements, said operating device (56) comprises an indicating panel (58) rotatably mounted so as to fold down over said indicating elements, in a folded down position said indicating panel rests on said indicating elements and actuates a switch (59) for switching over said indicating elements (57), said switch (59) comprises a magnet (60) connected to said indicating panel (58), and a Hall contact (61) located in said operating device (56).

12. A hair drier hood, as set forth in claim 11, wherein a heat responsive temperature sensor (63) pivotally mounted on said cap, said sensor (63) projects into the space defined by said cap and said arms and is connected to a device for controlling the heat of the heating elements, said sensor (63) is affixed to a cross rail (64) of a U-shaped support (62) of said cap, said cross rail having a pair opposite ends with a support arm (65) at each of said ends with said support arms pivotally mounted on said cap, and a measuring device (67) for measuring an angle (68) between said cap and said support and connected to said device for controlling the heat from the heating elements.

* * * * *